US010873159B1

(12) United States Patent
Ljubijankic et al.

(10) Patent No.: US 10,873,159 B1
(45) Date of Patent: Dec. 22, 2020

(54) ELECTRICAL CONNECTOR WAFER ASSEMBLY

(71) Applicant: Amphenol Corporation, Wallingford, CT (US)

(72) Inventors: Zlatan Ljubijankic, Mississauga (CA); Barbara H. Marten, Toronto (CA); Alfranco Salcedo, North Bergen, NJ (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 16/425,075

(22) Filed: May 29, 2019

(51) Int. Cl.

| | |
|---|---|
| ***H01R 13/502*** | (2006.01) |
| ***H01R 13/6471*** | (2011.01) |
| ***H01R 13/62*** | (2006.01) |
| ***H01R 43/24*** | (2006.01) |
| ***H01R 13/405*** | (2006.01) |

(52) U.S. Cl.
CPC ..... *H01R 13/6471* (2013.01); *H01R 13/405* (2013.01); *H01R 13/502* (2013.01); *H01R 13/62* (2013.01); *H01R 43/24* (2013.01)

(58) Field of Classification Search
CPC ..... H01R 13/658; H01R 13/6594; H01R 13/502; H01R 13/40; H01R 13/405; H01R 13/514; H01R 9/03; H01R 9/0512; H01R 43/24; H01R 24/40; H01R 24/86
See application file for complete search history.

(56) References Cited

U.S. PATENT DOCUMENTS

| | | | | |
|---|---|---|---|---|
| 4,902,092 | A | 2/1990 | Grandy | |
| 5,860,816 | A * | 1/1999 | Provencher | H01R 13/7195 439/79 |
| 6,908,346 | B1 | 6/2005 | Hyzin | |
| 7,775,725 | B2 | 8/2010 | Grinderslev | |
| 8,827,567 | B2 | 9/2014 | Grinderslev | |
| 9,806,468 | B2 * | 10/2017 | Liao | H01R 12/721 |
| 9,865,977 | B2 * | 1/2018 | Resendez | H01R 9/034 |
| 2001/0012729 | A1 | 8/2001 | Van Woensel | |
| 2008/0171474 | A1 * | 7/2008 | Thomas | H01R 23/688 439/626 |
| 2011/0281454 | A1 | 11/2011 | Phillips et al. | |
| 2014/0162488 | A1 | 6/2014 | Staudigel et al. | |
| 2017/0302033 | A1 | 10/2017 | Peng et al. | |
| 2017/0310035 | A1 | 10/2017 | Schmitt et al. | |
| 2017/0373438 | A1 | 12/2017 | Qiu et al. | |
| 2018/0097311 | A1 | 4/2018 | Ju | |
| 2018/0166825 | A1 | 6/2018 | Ju | |

FOREIGN PATENT DOCUMENTS

| | | | |
|---|---|---|---|
| CN | 205583232 | U | 9/2016 |
| DE | 3900091 | A1 | 7/1989 |

* cited by examiner

*Primary Examiner* — Vanessa Girardi
(74) *Attorney, Agent, or Firm* — Blank Rome LLP

(57) ABSTRACT

An electrical connector, and method of assembly, that has a conductive connector shell and a contact subassembly received therein. The contact subassembly has first and second signal wafers and a ground wafer sandwiched between the signal wafers. Each of the signal wafers includes one or more signal contacts and a dielectric wafer body formed around the signal contacts such that the tail and mating ends of the signal contacts are outside of the wafer body. The ground wafer includes one or more ground contacts and a dielectric wafer body formed around the ground contacts such that the tail ends of the ground contacts are outside of the wafer body of the ground wafer.

30 Claims, 4 Drawing Sheets

ELECTRICAL CONNECTOR WAFER ASSEMBLY

FIELD OF THE INVENTION

The present invention relates to an electrical connector, and method of efficiently assembling the same, with high electrical performance at a low manufacturing cost.

BACKGROUND

High speed electrical connectors, such as a Twinax or Quadrax connector, transmit high speed signals at low losses. Such high speed electrical connectors may be used for transmitting and receiving various types of data, for example, for defense and commercial applications. In certain applications, these high speed electrical connectors mount to a printed circuit board and electrical connect with the circuit traces thereof. The machining of these high speed data connectors, however, is costly time consuming, particularly due to the high cycle time. Therefore, a need exists for a high speed data connector that is less expensive to manufacture while also providing high electrical performance.

SUMMARY

Accordingly, the present invention may provide an electrical connector that comprises a conductive connector shell that has a mating interface end and an opposite board engagement end. and a contact subassembly received in the connector shell. The contact subassembly comprises first and second signal wafers and a ground wafer separate from the first and second signal wafers and the ground wafer is sandwiched between the first and second signal wafers. Each of the first and second signal wafers may include one or more signal contacts that has a tail end and an opposite mating end, and a dielectric wafer body formed around the one or more signal contacts such that the tail and mating ends of the one or more signal contacts are outside of the wafer body. The tail end of the one or more signal contacts may extend through and beyond the board engagement end of the connector shell and the mating end of the one more signal contacts may extend toward the mating interface end of the connector shell. The ground wafer may include one or more ground contacts and a dielectric wafer body formed around the one or more ground contacts such that a tail end of the one or more ground contacts is outside of the wafer body of the ground wafer and may extend through and beyond the board engagement end of the connector shell.

In certain embodiments, the wafer body of the first and second signal wafers forms an overmold around the one or more signal contacts such that the one or more signal contacts are integral with the wafer body of the first and second signal wafers; the wafer body of the ground wafer forms an overmold around the one or more ground contacts such that the one or more ground contacts are integral with the wafer body of the ground wafer; the one or more ground contacts of the ground wafer are in electrical continuity with the connector shell; the wafer body of the ground wafer includes a conductive continuity member in contact with the one or more ground contacts and the connector shell to provide the electrical continuity; and/or the continuity member is a spring arm extending from one or more of the ground contacts supported by the wafer body of the ground wafer.

In other embodiments, each of the wafer bodies of the first and second signal wafers has a locating member configured to couple with the wafer body of the ground wafer; each of the wafer bodies of the first and second signal wafers has an engagement member configured to engage the locating member of the other signal wafer; the location member is a post and the engagement member is a hole sized to receive the post; wherein the wafer body of the ground wafer has first and second opposing faces facing the first and second signal wafers, respectively, and at least the first opposing face has at least one isolation extension extending through the wafer body of the first signal wafer adjacent to the one or more signal contacts of the first signal wafer; the wafer body of the first signal wafer has a window disposed therein that exposes a portion of the one or more signal contacts therein and receives the isolation extension from the ground wafer; the isolation extension of the ground wafer extends from a middle portion of the first opposing face, and another isolation extension extends from an edge portion of the first opposing face, the another isolation extension extends through the window adjacent to the one or more signal contacts of the first signal wafer; and/or the connector shell includes at least one notch at the board engagement end thereof that is configured to receive a portion of the wafer body of the ground wafer.

The present invention may also provide an electrical connector that comprises a conductive connector shell that has a mating interface end and an opposite board engagement end and a contact subassembly received in the connector shell. The contact subassembly may comprise first and second signal wafers and a ground wafer separate from the first and second signal wafers, and the ground wafer is sandwiched between the first and second wafers. Each of the first and second signal wafers may include a plurality signal contacts that each have a tail end and an opposite mating end, and a dielectric wafer body overmolded around the signal contacts such that the signal contacts are integral with the wafer body, the signal contacts are laterally spaced from one another, and the tail and mating ends of the signal contacts are outside of the wafer body. The tail ends extend through and beyond the board engagement end of the connector shell and the mating ends extend toward the mating interface end of the connector shell. The ground wafer may include a plurality of ground contacts and a dielectric wafer body overmolded around the ground contacts such that the ground contacts are integral with the wafer body of the ground wafer, the ground contacts are laterally spaced from one another, and a tail end of each of the ground contacts is outside of the wafer body of the ground wafer and extends through and beyond the board engagement end of the connector shell. The ground contacts may be in electrical continuity with the connector shell.

In some embodiments, the wafer body of the ground wafer has first and second opposing faces facing the first and second signal wafers, respectively, and each of the first and second opposing faces has at least one isolation extension extending through the wafer body of the first and second signal wafers, respectively, adjacent to one or more of the signal contacts; the wafer body of each of the first and second signal wafers has a window disposed therein that exposes a portion of each of the signal contacts therein and receives the isolation extension from the first and second opposing faces, respectively, of the ground wafer; each of the wafer bodies of the first and second signal wafers has a locating member configured to couple with the wafer body of the ground wafer and engage the wafer body of the other signal wafer; and/or the wafer body of the ground wafer includes a conductive continuity member in contact with at least one of the ground contacts and an inner surface of the connector shell to provide the electrical continuity.

The present invention may yet further provide a method of assembling an electrical connector that comprises the steps of engaging first and second signal wafers together and sandwiching a ground wafer therebetween, thereby creating a contact subassembly, wherein each of the first and second signal wafers includes one or more signal contacts and a dielectric wafer body formed around the signal contacts and the ground wafer includes one or more ground contacts and a dielectric wafer body formed around the ground contacts; inserting the contact subassembly into a conductive connector shell, such that tail ends of the signal contacts and tail ends of the ground contacts extend through and beyond a board engagement end of the connector shell and mating ends of the signal contacts extend toward a mating end of the connector shell; and attaching the contact subassembly to the connector shell.

In certain embodiments, the method further comprises the step of overmolding the wafer bodies around the one or more signal contacts of the first and second signal wafers, respectively, and overmolding the wafer body of the ground wafer around the one or more ground contacts prior to the step of creating the contact subassembly; the method further comprises the step of stamping the signal contacts and plating the mating ends thereof prior to the step of overmolding the wafer bodies around the signal contacts and stamping and plating the one or more ground contacts prior to the step of overmolding the wafer body of the ground wafer around the one or more ground contacts; and/or the step of attaching the contact subassembly to the connector shell includes adhering the contact subassembly to an inside of the connector shell.

In some embodiments of the method, after the step of inserting the contact subassembly into the connector shell, electrical continuity may established between the one or more ground contacts and the connector shell; may further comprise the step of locating the first and second signal wafers with respect to one another and the ground wafer when creating the contact subassembly; and/or may further comprising the step of electrically isolating the signal contacts of each of the first and second wafers, prior to creating the contact subassembly.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION

Referring to the figures, the present invention relates to an electrical connector 100 designed to be less expensive and more efficient to manufacture than traditional electrical connectors, while also providing high electrical performance, such as when used for high speed data transmission. The design of electrical connector 100 also improves electrical performance, including impedance tuning of its contacts, which is particularly important for high date rate transfer, for example. Electrical connector 100 generally comprises a conductive connector shell 102 and a contact subassembly 104 received in the shell 102. Contact subassembly 104 is configured to be received in the shell 102 such that grounding/electrical continuity is established therebetween while also electrically isolating the signal contacts of the subassembly 104 to improve electrical performance.

Figure 1:
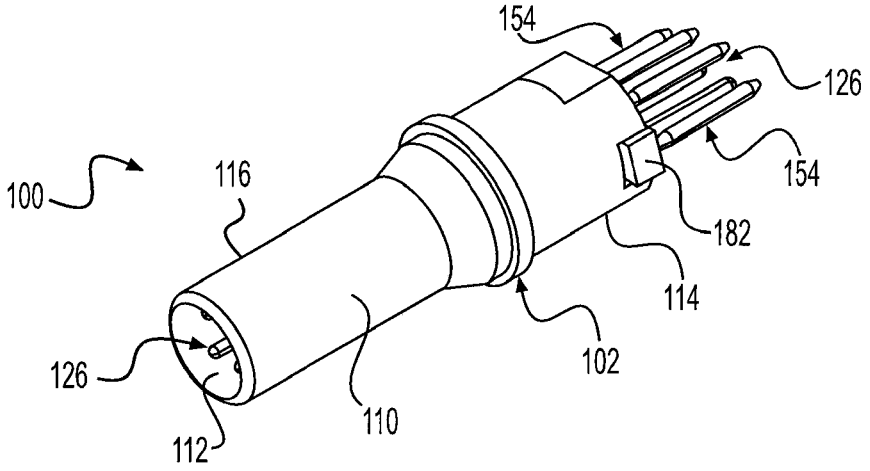
FIG. 1 is a perspective view of an electrical connector according to an exemplary embodiment of the present invention.

As seen in FIG. 1, connector shell 102 may be a generally cylindrical housing 110 with an inner surface 112 defining a receiving area for the contact subassembly 104. Housing 110 has a mating interface end 116 for connecting to a mating cable receptacle connector or to a receptacle connector also terminated to the board and an opposite board engagement end 114 for connecting to a printed circuit board.

Figure 2:
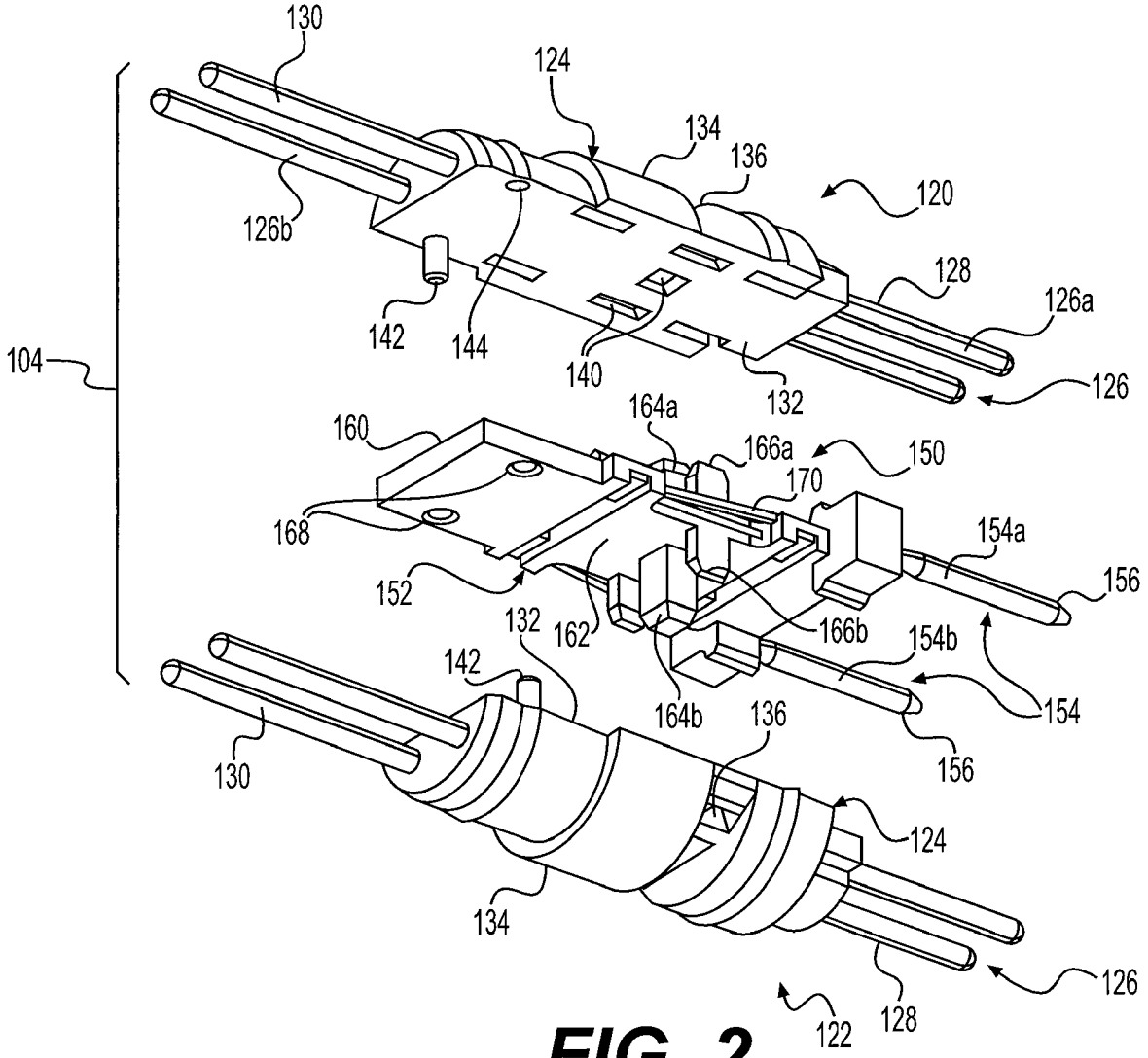
FIG. 2 is an exploded perspective view of a contact subassembly of the electrical connector illustrated in FIG. 1.
Figure 3A:
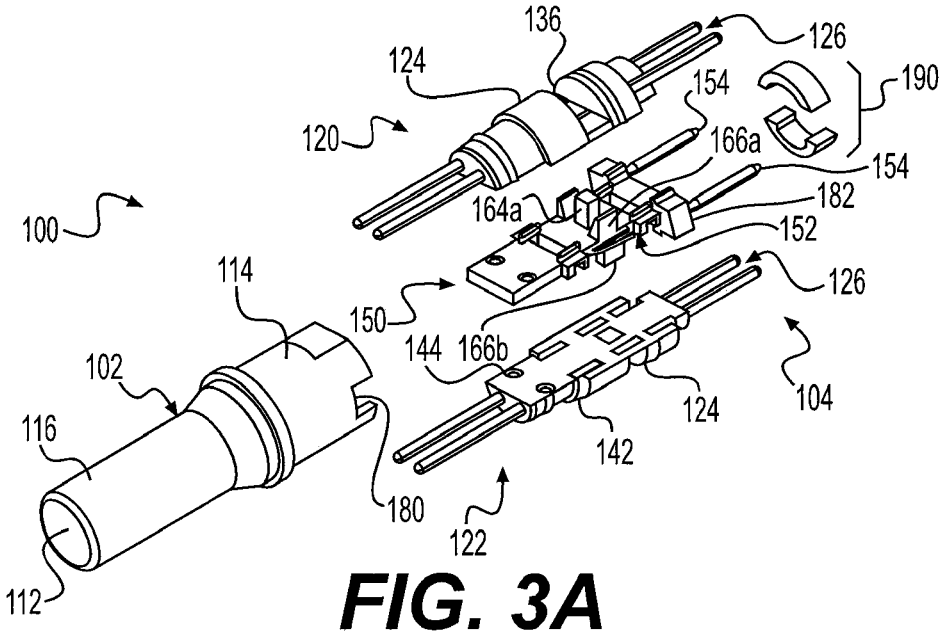
FIGS. 3A-3C are perspective views of exemplary steps for assembling the electrical connector illustrated in FIG. 1.
Figure 3B:
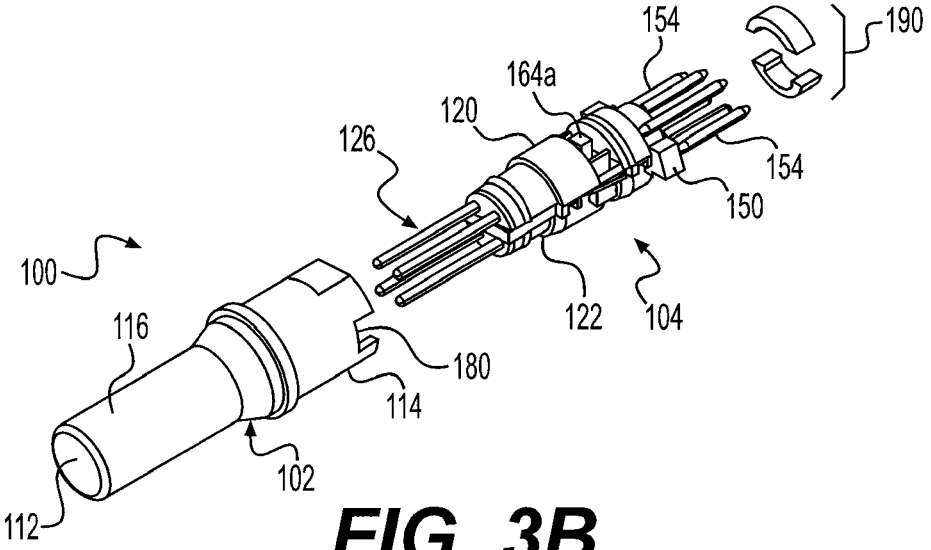

Contact subassembly 104 may comprise first and second signal wafers 120 and 122 with a ground wafer 150 sandwiched therebetween, as best seen in FIGS. 2 and 3B. Each of the signal wafers 120 and 122 may comprise a dielectric wafer body 124 and one or more signal contacts 126. In a preferred embodiment, wafer body 124 is formed around the signal contacts 126. For example, the wafer body 124 may be overmolded onto and over the signal contacts 126 such that the signal contacts 126 become integral with wafer body 124, that is they cannot be readily separated from wafer body 124 without destroying the wafer body 124. Each signal contact 126 has a tail end 128 and an opposite mating end 130. When forming wafer body 124 around the signal contacts 126, e.g. by overmolding, the tail ends 128 and the opposite mating ends 130 may be left uncovered or outside of wafer body 124. In one embodiment, wafer body 124 is formed around two signal contacts 126*a* and 126*b* (FIG. 2) that may be oriented such that they can be laterally spaced from and substantially parallel to one another.

Figure 4A:
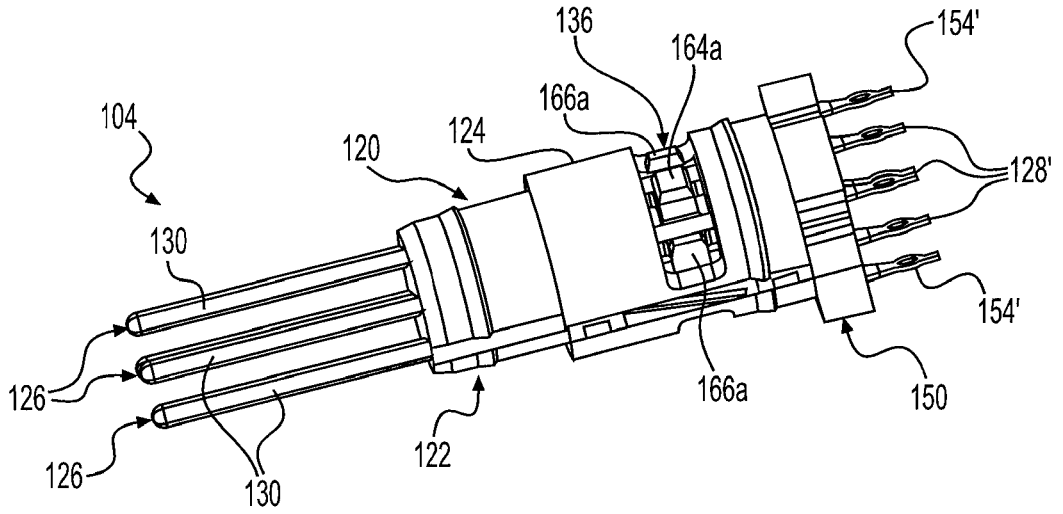
FIGS. 4A and 4B are perspective and enlarged views, respectively, of the assembled contact subassembly of the electrical connector.
Figure 4B:
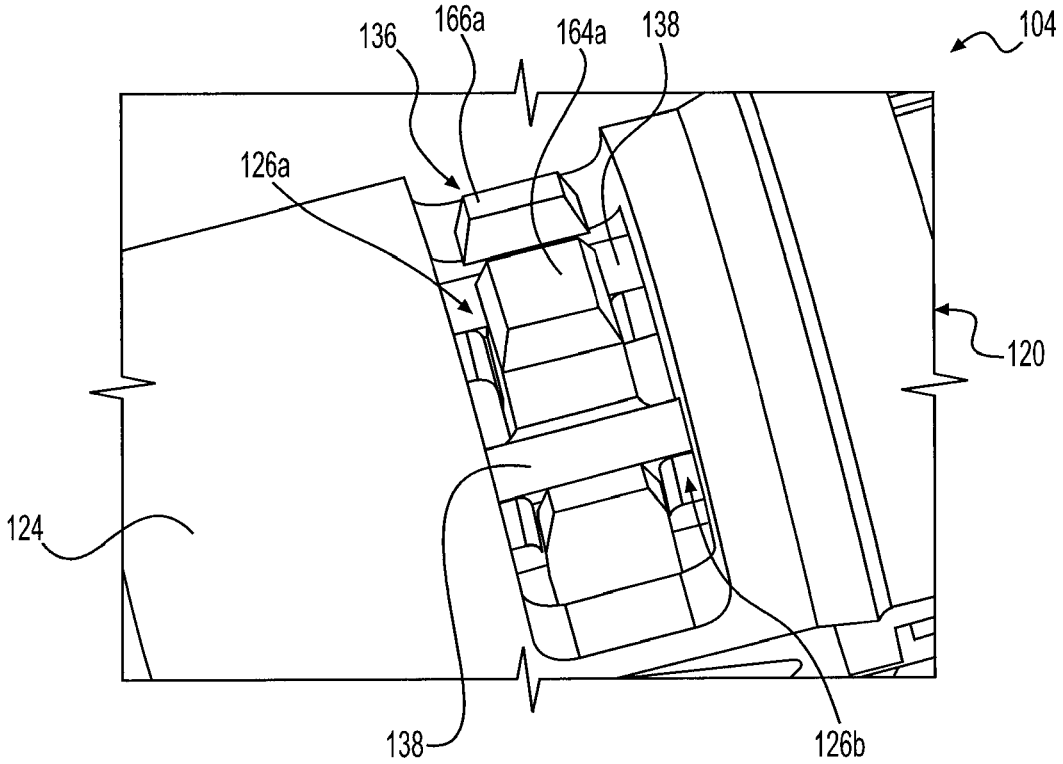

Each wafer body 124 has an inner surface 132 facing ground wafer 150 and an outer surface 134. In one embodiment, the inner surface 132 is substantially flat and the outer surface 134 is rounded or curved such that the cross-sectional shape of wafer body 124 is generally semi-circular. A window 136 may be formed in the outer surface 134 of the wafer body 124, thereby exposing a portion 138 of each signal contact 126, as seen in FIGS. 4A and 4B. Inner surface 132 of wafer body 124 may have one or more openings 140 (FIG. 2) in communication with window 136.

Each wafer body 124 of the first and second signal wafers 120 and 122 may have one or more locating members 142 configured to couple with the ground wafer 150. Each wafer body 124 may also have an engagement member 144 configured to engage the other signal wafer 120 or 122. In one embodiment, the engagement members 144 may be configured to engage the locating members 142 of the other signal wafer 120 or 122. For example, the location member 142 of the wafer body of the first signal wafer 120 can engage the engagement member 144 of the wafer body 124 of the second signal wafer 122, and vise-versa. The location and engagement members 142 and 144 act to properly locate and position the signal wafers 120 and 122 along with the ground wafer 150 when creating contact subassembly 104. In one embodiment, each locating member 142 is a post extending from the inner surface 132 of wafer body 124 and each engagement member 144 is a corresponding hole in the inner surface 132 that can receive the post.

Ground wafer 150 may comprise a dielectric wafer body 152 and one or more ground contacts 154. In a preferred embodiment, wafer body 152 is formed around the ground contacts 154 that are spaced from one another similar to the wafer body 124 of the signal wafers 120 and 122. Wafer body 152 may be overmolded onto the ground contacts 154 such that the ground contacts 154 become integral with wafer body 152. Each ground contact 154 has a tail end 156 extending from wafer body 152. That is, when forming wafer body 152 around the ground contacts 154, e.g. by overmolding, the tail ends 156 may be left uncovered or outside of wafer body 152. In one embodiment, wafer body 152 is formed around two ground contacts 154*a* and 154*b* (FIG. 2) that may be oriented such that they can be laterally spaced from and substantially parallel to one another. In one embodiment, ground contacts 154*a* and 154*b* are laterally spaced from one another for a distance greater than the distance between signal contacts 126*a* and 126*b*. The contacts 126*a* and 126*b* may be arranged as a standard Quadrax, for example, such that the differential pair are diagonally opposite one another with the ground contact 154*a* and 154*b* therebetween. In another embodiment, a ground plate may be provided between the ground contacts 154*a* and 154*b*, thereby allowing for a split pair Quadrax where the differential pair is separated by the ground contacts 154*a* and 154*b* and the ground plate.

Tail ends 128 of the signal contacts 126 and the tail ends 156 of the ground contacts 154 may be configured to engage a printed circuit board mechanically and electrically, such as by soldering them to the board or by configuring the tail ends 128' and 156' as press-fit pins (FIG. 4A) that press fit into the board.

Wafer body 152 of ground wafer 150 has first and second opposing faces 160 and 162 facing the inner surfaces 132 of first and second signal wafers 120 and 122, respectively. Each of the opposing faces 160 and 162 may have at least one isolation extension 164*a* and 164*b*. Each isolation extension 164*a* and 164*b* may be sized and configured to extend through one of the openings 140 in the signal wafers' inner surfaces 132 and into window 136. In a preferred embodiment, each isolation extension 164*a* and 164*b* is positioned near or adjacent to the exposed portions 138 of the signal contacts 126, as seen in FIG. 4B. For example, each isolation extension 164*a* and 164*b* may by positioned on a middle portion of wafer body 152 and extend between the signal contacts 126*a* and 126*b* of the first and second signal wafers 120 and 122, respectively, to assist with electrical isolation of the signal contacts. Because air is a dielectric, window 136 also assists with the electrical isolation of the signal contacts 126. Isolation extensions 164*a* and 164*b*, by virtue of extending into the windows 136 of signal wafers 120 and 122, respectively, may also assist with locating and positioning of the signal and ground wafers. One or more through bores 168 may be provided in wafer body 152 that are positioned therein to be generally aligned with and receive the locating members 142 of signal wafers 120 and 122 when assembled into contact subassembly 104.

Additional or secondary isolation extensions 166*a* and 166*b* may also be provided on the opposing faces 160 and 162 of the ground wafer body 152. These isolation extensions 166*a* and 166*b* may also extend through one of the openings 140 in the signal wafers and into their respective windows 136 such that the isolation extensions 166*a* and 166*b* are near or adjacent at least one of the signal contacts 126. For example, the isolation extensions 166*a* and 166*b* (FIGS. 2 and 3A) may be positioned at or near an edge of wafer body 152 such that they are outside of the signal contacts 126*a* and 126*b*, thereby further electrically isolating the signal contacts.

Figure 6:
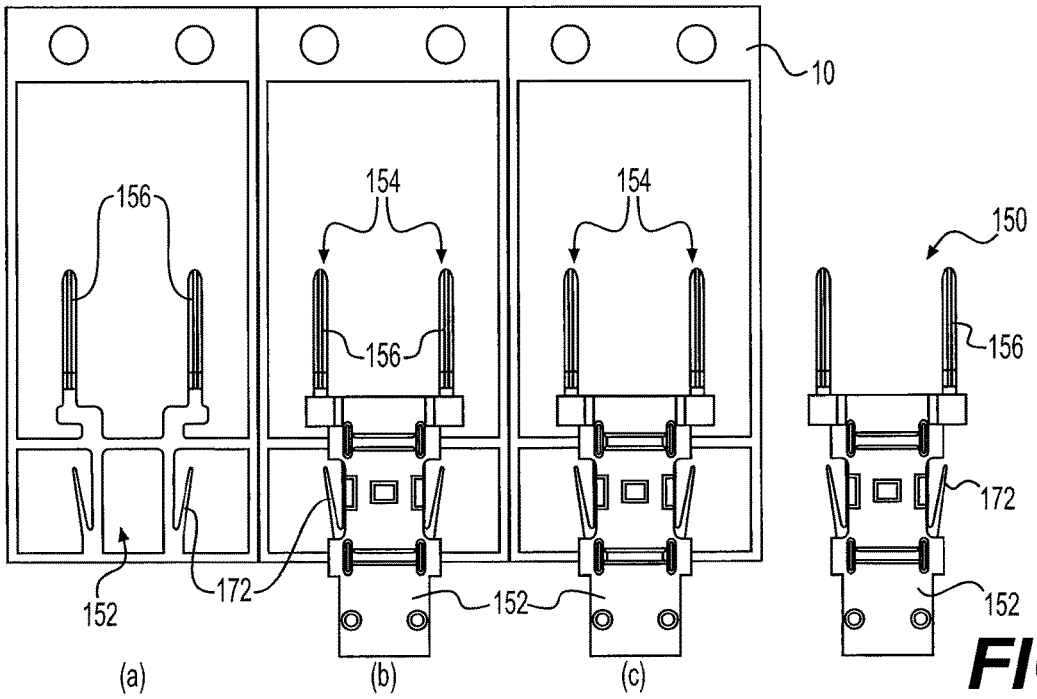
FIG. 6 is a plan view of exemplary steps for making a ground wafer of the electrical connector illustrated in FIG. 1.

In a preferred embodiment, the ground contacts 154 may be in electrical continuity with the connector shell 102, thereby establishing a grounding path through electrical connector 100. One or more conductive continuity members 170 may be provided in the ground wafer body 154 that electrically connects the connector shell 102 and the ground contacts 154. Continuity member 170 may be, for example, a spring arm 172, that is preferably formed integrally with each ground contact 154 (FIG. 6). The spring arm 172 is designed to bias outwardly and make contact with connector shell 102, such as the inner surface 112 of shell 102.

Figure 3C:
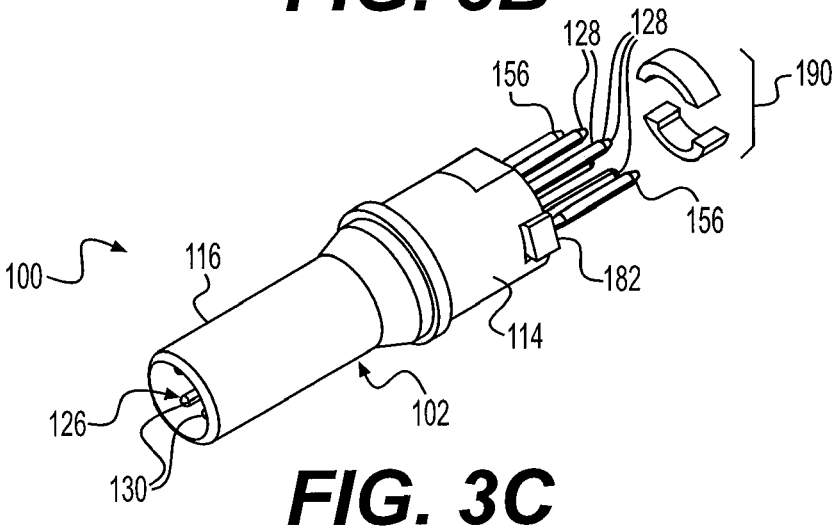

As seen in FIGS. 3A-3C, to assemble electrical connector 100, the contact subassembly 104 is first created or assembled and then inserted into the connector shell 102. Connector shell 102 may include one or more notches 180 at its board engagement end 114 thereof that are configured to receive one or more abutment portions 182 that extend from the wafer body 152 of the ground wafer 150. That is, contact subassembly 104 may be inserted into the board engagement end 114 of connector shell 102 until abutment portions 182 are received in and abut against the notches 180.

Creating contact subassembly 104 generally involves engaging first and second signal wafers 120 and 122 together and sandwiching ground wafer 150 between the inner surfaces 132 of the signal wafers 120 and 122. Signal wafers 120 and 122 may be engaged by, for example, inserting the respective locating members 142, such as a post, on the signal wafer body inner surfaces 132 thereof, into the respective engagement members 144, such as a corresponding hole, in the signal wafer body inner surfaces 132 thereof. Those locating members 142 may also extend through the through bores 168 of the wafer body 152 of ground wafer 150 for proper positioning and alignment of the wafers 120, 122, and 150 when assembling together.

Isolation extensions 164*a* and 164*b* and isolation extensions 166*a* and 166*b* may extend into respective windows 136 of the first and second signal wafers 120 and 122, and adjacent to the exposed portions 138 of the signal contacts 126. In a preferred embodiment, each of the signal contacts 126 is located between at least two isolation extensions of ground wafer 150, such as between middle isolation extension 164*a* and outer isolation extension 166*a*, as seen in FIG. 4B, for electrically isolating the signal contacts 126.

Once contact subassembly 104 is assembled, it can be inserted into conductive connector shell 102, preferably through its board engagement end 114, such that tail ends 128 of the signal contacts 126 and tail ends 156 of the ground contacts 154 extend through and beyond the shell's board engagement end 114 and mating ends 130 of the signal contacts 126 extend toward mating interface end 116 of connector shell 102. Also, ground spring arm 172, which extends outwardly from the wafer body 152 of ground wafer 152, engages the connector shell's inner surface 112 to establish electrical continuity between contact subassembly 104 and shell 102. Contact subassembly 104 may then be attached to connector shell 102, such as by applying an adhesive or epoxy 190 between contact subassembly 104 and the inner surface 112 of connector shell 102.

Figure 5:
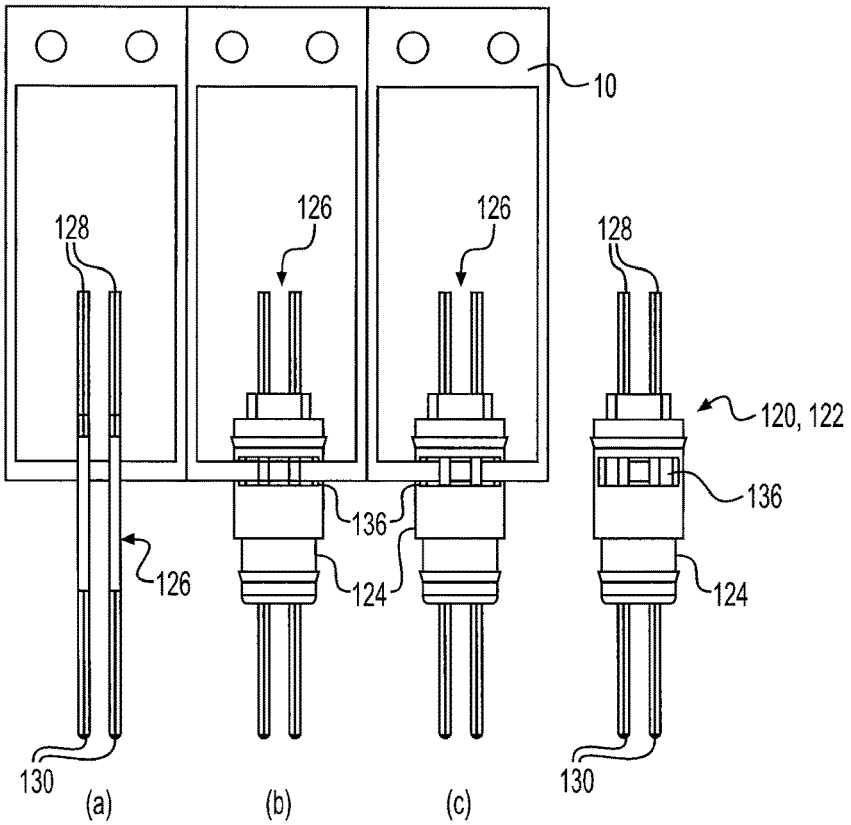
FIG. 5 is a plan view of exemplary steps for making a signal wafer of the electrical connector illustrated in FIG. 1.

As seen in FIG. 5, each signal wafer 120 and 122 may be made, for example, by (a) stamping one or more contacts 126 such that they are laterally spaced and generally parallel to one another and plating the mating ends 130 of each contact 126; (b) overmolding the dielectric wafer body 124 around and over the mid-portions of the contacts 126, leaving the window 136 in each wafer body; and (c) cutting and removing the carrier strip 10 from the overmolded wafer body 124. Stamping of the contacts 126 allows for impedance tuning. That is because when signal contacts transition from being in open air to residing in an insulator or dielectric, such as plastic, the impedance changes, thus resulting an impedance mismatch. The stamped contacts 126 are inherently more adaptable for impedance tuning (addressing impedance mismatch) than the conventional machined contacts. For example, the contacts 126 inside the dielectric wafer body 124 can be moved closer or further away from ground wafer 150 without changing the cross-section of the individual contacts. Also, the contacts 126 inside of wafer body 124 can be moved closer to, or further apart from each other, as needed. Conventional machined contacts cannot be moved.

As seen in FIG. 6, ground wafer 150 is formed in a manner similar to signal wafers 120 and 122, including (a) stamping one or more ground contacts 154; (b) overmolding the dielectric wafer body 152 around and over the ground contacts 154 leaving the contacts' tail ends 156 uncovered and the grounding spring arms 172 exposed; and (c) cutting and removing the carrier strip 10 from the overmolded wafer body 152.

While particular embodiments have been chosen to illustrate the invention, it will be understood by those skilled in the art that various changes and modifications can be made therein without departing from the scope of the invention as defined in the appended claims. For example, although electrical connector 100 is shown as having its contacts in Quadrax arrangement, the present invention contemplates over connector types, such as one or more straight pin contacts, twinax, coax, parallel array contacts or any other type of electrical contacts, suitable for carrying a variety of signal types.

What is claimed is:

1. An electrical connector, comprising:

a conductive connector shell having a receiving area, a mating interface end, and a board engagement end; and a contact subassembly received in the receiving area of the connector shell such that the contact subassembly is generally enclosed by the connector shell, the contact subassembly comprising, first and second signal wafers and a ground wafer separate from the first and second signal wafers, the ground wafer being sandwiched between the first and second signal wafers, each of the first and second signal wafers including one or more signal contacts that has a tail end and an opposite mating end, and a dielectric wafer body formed around the one or more signal contacts such that the tail and mating ends of the one or more signal contacts extend beyond the wafer body with the tail end of the one or more signal contacts extending through and beyond the board engagement end of the connector shell and the mating end of the one more signal contacts extending toward the mating interface end of the connector shell, the ground wafer including one or more ground contacts and a dielectric wafer body formed around the one or more ground contacts such that a tail end of the one or more ground contacts extends beyond the wafer body of the ground wafer and the board engagement end of the connector shell, and wherein the connector shell includes at least one notch at the board engagement end thereof that is configured to receive a portion of the wafer body of the ground wafer.

2. An electrical connector, comprising:

a conductive connector shell having a receiving area, a mating interface end, and a board engagement end; and a contact subassembly received in the receiving area of the connector shell such that the contact subassembly is generally enclosed by the connector shell, the contact subassembly comprising, first and second signal wafers and a ground wafer separate from the first and second signal wafers, the ground wafer being sandwiched between the first and second signal wafers, each of the first and second signal wafers including one or more signal contacts that has a tail end and an opposite mating end, and a dielectric wafer body formed around the one or more signal contacts such that the tail and mating ends of the one or more signal contacts extend beyond the wafer body with the tail end of the one or more signal contacts extending through and beyond the board engagement end of the connector shell and the mating end of the one more signal contacts extending toward the mating interface end of the connector shell, both signal wafer dielectric wafer bodies substantially mirror each other in that they have a definitively non-planar outer surface and a substantially planar inner surface which faces the ground wafer, and the ground wafer including one or more ground contacts and a dielectric wafer body formed around the one or more ground contacts such that a tail end of the one or more ground contacts extends beyond the wafer body of the ground wafer and the board engagement end of the connector shell.

3. The electrical connector of claim 2, wherein the wafer body of the first and second signal wafers forms an overmold around the one or more signal contacts such that the one or more signal contacts are integral with the wafer body of the first and second signal wafers.

4. The electrical connector of claim 2, wherein the wafer body of the ground wafer forms an overmold around the one or more ground contacts such that the one or more ground contacts are integral with the wafer body of the ground wafer.

5. The electrical connector of claim 2, wherein the connector shell includes at least one notch at the board engagement end thereof that is configured to receive a portion of the wafer body of the ground wafer.

6. The electrical connector of claim 2, wherein the first and second signal wafers are substantially the same.

7. The electrical connector of claim 2, wherein the connector shell is substantially cylindrical.

8. The electrical connector of claim 2, wherein the mating and tail ends of each signal contact are axially aligned.

9. The electrical connector of claim 2, wherein both the first and second signal wafers are directly coupled to the ground wafer.

10. The electrical connector of claim 2, wherein the one or more ground contacts of the ground wafer are in electrical continuity with the connector shell.

11. The electrical connector of claim 10, wherein the wafer body of the ground wafer includes a conductive continuity member in contact with the one or more ground contacts and the connector shell to provide the electrical continuity.

12. The electrical connector of claim 11, wherein the continuity member is a spring arm extending from one or more of the ground contacts supported by the wafer body of the ground wafer.

13. The electrical connector of claim 2, wherein each of the wafer bodies of the first and second signal wafers has a locating member configured to couple with the wafer body of the ground wafer.

14. The electrical connector of claim 13, wherein each of the wafer bodies of the first and second signal wafers has an engagement member configured to engage the locating member of the other signal wafer.

15. The electrical connector of claim 14, wherein the location member is a post and the engagement member is a hole sized to receive the post.

16. The electrical connector of claim 2, wherein the wafer body of the ground wafer has first and second opposing faces facing the first and second signal wafers, respectively, and at least the first opposing face has at least one isolation extension extending through the wafer body of the first signal wafer adjacent to the one or more signal contacts of the first signal wafer.

17. The electrical connector of claim 16, wherein the wafer body of the first signal wafer has a window disposed therein that exposes a portion of the one or more signal contacts therein and receives the isolation extension from the ground wafer.

18. The electrical connector of claim 17, wherein the isolation extension of the ground wafer extends from a middle portion of the first opposing face, and another isolation extension extends from an edge portion of the first opposing face, the another isolation extension extends through the window adjacent to the one or more signal contacts of the first signal wafer.

19. An electrical connector, comprising:

a conductive connector shell having a mating interface end and an opposite board engagement end; and a contact subassembly received in a receiving area of the connector shell, such that the contact subassembly is generally enclosed by connector shell, the contact subassembly comprising, first and second signal wafers and a ground wafer separate from the first and second signal wafers, the ground wafer being sandwiched between the first and second wafers, each of the first and second signal wafers including a plurality signal contacts that each have a tail end and an opposite mating end, and a dielectric wafer body overmolded around the signal contacts such that the signal contacts are integral with the wafer body, the signal contacts are laterally spaced from one another, and the tail and mating ends of the signal contacts extend beyond the wafer body, with the tail ends extending through and beyond the board engagement end of the connector shell and the mating ends extending toward the mating interface end of the connector shell, both signal wafer dielectric wafer bodies substantially mirror each other in that they have a definitively non-planar outer surface and a substantially planar inner surface which faces the ground wafer, and the ground wafer including a plurality of ground contacts and a dielectric wafer body overmolded around the ground contacts such that the ground contacts are integral with the wafer body of the ground wafer, the ground contacts are laterally spaced from one another, and a tail end of each of the ground contacts extends beyond the wafer body of the ground wafer and the board engagement end of the connector shell wherein the ground contacts are in electrical continuity with the connector shell.

20. The electrical connector of claim 19, wherein each of the wafer bodies of the first and second signal wafers has a locating member configured to couple with the wafer body of the ground wafer and engage the wafer body of the other signal wafer.

21. The electrical connector of claim 19, wherein the wafer body of the ground wafer includes a conductive continuity member in contact with at least one of the ground contacts and an inner surface of the connector shell to provide the electrical continuity.

22. The electrical connector of claim 19, wherein the wafer body of the ground wafer has first and second opposing faces facing the first and second signal wafers, respectively, and each of the first and second opposing faces has at least one isolation extension extending through the wafer body of the first and second signal wafers, respectively, adjacent to one or more of the signal contacts.

23. The electrical connector of claim 22, wherein the wafer body of each of the first and second signal wafers has a window disposed therein that exposes a portion of each of the signal contacts therein and receives the isolation extension from the first and second opposing faces, respectively, of the ground wafer.

24. A method of assembling an electrical connector, comprising the steps of engaging first and second signal wafers together, each of the first and second signal wafers engaging a ground wafer and sandwiching the ground wafer therebetween, thereby creating a contact subassembly, wherein each of the first and second signal wafers includes one or more signal contacts and a dielectric wafer body formed around the signal contacts and the ground wafer includes one or more ground contacts and a dielectric wafer body formed around the ground contacts, and wherein both signal wafer dielectric wafer bodies substantially mirror each other in that they have a definitively non-planar outer surface and a substantially planar inner surface which faces the ground wafer;

inserting the contact subassembly into a receiving area of a conductive connector shell, such that the connector shell generally encloses the contact subassembly and tail ends of the signal contacts and tail ends of the ground contacts extend through and beyond a board engagement end of the connector shell and mating ends of the signal contacts extend toward a mating end of the connector shell; and attaching the contact subassembly to the connector shell.

25. The method of claim 24, wherein the step of attaching the contact subassembly to the connector shell includes adhering the contact subassembly to an inside of the connector shell.

26. The method of claim 24, wherein after the step of inserting the contact subassembly into the connector shell, establishing electrical continuity between the one or more ground contacts and the connector shell.

27. The method of claim 24, further comprising the step of locating the first and second signal wafers with respect to one another and the ground wafer when creating the contact subassembly.

28. The method of claim 24, further comprising the step of electrically isolating the signal contacts of each of the first and second wafers, prior to creating the contact subassembly.

29. The method of claim 24, further comprising the step of overmolding the wafer bodies around the one or more signal contacts of the first and second signal wafers, respectively, and overmolding the wafer body of the ground wafer around the one or more ground contacts prior to the step of creating the contact subassembly.

30. The method of claim 29, further comprising the step of stamping the signal contacts and plating the mating ends thereof prior to the step of overmolding the wafer bodies around the signal contacts and stamping and plating the one or more ground contacts prior to the step of overmolding the wafer body of the ground wafer around the one or more ground contacts.

* * * * *